US007111553B2

(12) United States Patent
Sejima et al.

(10) Patent No.: US 7,111,553 B2
(45) Date of Patent: Sep. 26, 2006

(54) METHOD OF KNEADING INK OF A PRINTING PRESS AND PRINTING PRESS

(75) Inventors: Atsushi Sejima, Fuchu (JP); Masahiro Hino, Fuchu (JP)

(73) Assignee: Ryobi Ltd., (JP)

( * ) Notice: Subject to any disclaimer, the term of this patent is extended or adjusted under 35 U.S.C. 154(b) by 147 days.

(21) Appl. No.: 11/004,207

(22) Filed: Dec. 3, 2004

(65) Prior Publication Data

US 2005/0120897 A1 Jun. 9, 2005

(30) Foreign Application Priority Data

Dec. 8, 2003 (JP) ..... 2003-409384

(51) Int. Cl.
*B41F 31/02* (2006.01)
*B41F 31/00* (2006.01)

(52) U.S. Cl. ..... 101/365; 101/350.1; 101/350.2; 101/350.3; 101/350.4; 101/351.3; 101/352.01; 101/352.05

(58) Field of Classification Search ..... 101/365, 101/350.1, 350.2, 350.3, 350.4, 351.3, 352.01, 101/352.05
See application file for complete search history.

(56) References Cited

U.S. PATENT DOCUMENTS

| | | | | |
|---|---|---|---|---|
| 3,871,294 | A * | 3/1975 | Kagari et al. | 101/132.5 |
| 5,447,102 | A | 9/1995 | Pfeiffer et al. | |
| 6,227,113 | B1 | 5/2001 | Dorenkamp | |
| 6,367,385 | B1 * | 4/2002 | Komori | 101/484 |
| 6,647,875 | B1 * | 11/2003 | Horikoshi | 101/216 |
| 6,742,451 | B1 | 6/2004 | Junghans | |
| 6,772,684 | B1 * | 8/2004 | Kanayama | 101/350.1 |
| 6,889,606 | B1 * | 5/2005 | Emura et al. | 101/365 |
| 6,999,200 | B1 * | 2/2006 | Shiraishi | 358/1.9 |
| 7,028,616 | B1 * | 4/2006 | Hirano et al. | 101/365 |
| 2001/0018875 | A1 * | 9/2001 | Shiki et al. | 101/365 |
| 2001/0020427 | A1 * | 9/2001 | Shiraishi | 101/365 |
| 2002/0139272 | A1 * | 10/2002 | Yamamoto et al. | 101/484 |
| 2003/0070570 | A1 * | 4/2003 | Yamamoto et al. | 101/365 |

FOREIGN PATENT DOCUMENTS

| | | |
|---|---|---|
| DE | 19815293 | 10/1999 |
| DE | 10028317 | 12/2000 |

* cited by examiner

*Primary Examiner*—Andrew H. Hirshfeld
*Assistant Examiner*—Marvin P. Crenshaw
(74) *Attorney, Agent, or Firm*—TIPS Group

(57) ABSTRACT

In a printing press, ink fountain keys are disposed to be movable toward and away from an ink fountain roller of an ink fountain to allow them to have a predetermined gap therebetween and hence the amount of ink to be fed to a downstream roller to be determined. The ink fountain roller is rotated while ink is prevented from being fed to the downstream roller. At least one of the ink fountain keys is moved so as to allow the at least one of the fountain keys to change a position thereof relative to the ink fountain roller of the ink fountain with time. With this arrangement, it is possible to improve an ink kneading effect produced by the rotation of the ink fountain roller without the necessity to manually knead ink in the ink fountain by the operator and the necessity to provide any ink kneading device or unit independently of the printing press.

4 Claims, 7 Drawing Sheets

METHOD OF KNEADING INK OF A PRINTING PRESS AND PRINTING PRESS

CROSS REFERENCE TO RELATED APPLICATION

This application claims priority from Japanese Patent Application No. 2003-409384, which is incorporated herein by reference.

BACKGROUND OF THE INVENTION

1. Field of the Invention

The present invention relates to a method of kneading ink of a printing press and a printing press.

2. Related Art

Among conventional printing presses, some printing presses are structured to have an ink fountain for storage of printing ink (hereinafter simply referred to ink), an ink fountain roller that rotates so as to make ink of the ink fountain adhere to its circumference and feed the ink therefrom to a downstream roller (e.g., an ink transfer roller), and one or more ink fountain keys that are aligned in a first direction parallel to the axis of the ink fountain roller and disposed so as to be moved back and forth in a second direction orthogonal to the first direction, thereby keeping a predetermined gap or space (hereinafter referred to gap) between the ink fountain roller and each of the ink fountain keys and hence determining the amount of ink to be fed to the downstream roller.

In the printing press of the above type, for example, ink fed from the ink fountain to the ink fountain roller is fed via a group of rollers comprising a number of rollers, which include ink transfer rollers disposed downstream to the ink fountain roller, to a plate cylinder with printing plates mounted thereon and then transferred from the plate cylinder to a rubber cylinder (a blanket cylinder) as a printing image. Ink which has been transferred as the printing image from the plate cylinder to the rubber cylinder is then transferred to substrates (e.g., printing sheets) that pass between the rubber cylinder and its corresponding impression cylinder, thereby printing the printing image on the substrates. Thus, the substrates with the printing image thereon (prints) are provided. In this printing operation, a predetermined gap is kept between each of the ink fountain keys and the ink fountain roller, thereby allowing a proper amount of ink for adjusting an image quality (image density) of prints to be fed from the ink fountain roller to the ink transfer roller. Thus, a desired image quality for prints can be attained. The image quality of prints to be printed is easy to be influenced by the characteristic change of ink. For example, ink in the ink fountain has its characteristics changed and viscosity generally increased in a case where the ink is left therein for a long time since the last printing operation of the printing press. It is known that the following phenomena may take place in such a case.

That is, in the printing operation, ink is kneaded by the rotation of the ink fountain roller as the printing proceeds and such kneading affects on ink, causing, in general, ink to have a viscosity lower than the viscosity of ink which has been left for a long time since the last printing operation. In more detail, in a case where the printing operation has been initiated with ink left in the ink fountain for a long time, the viscosity of this ink is increased at an initial stage of the printing operation, and therefore this highly viscous ink may likely cause print images to be printed on prints with a decreased ink density. As the printing operation proceeds further, the viscosity of ink is gradually decreased, thereby likely causing printing images to be printed on prints with an increased density. This change in density of ink printed on prints, due to the characteristic change (particularly, viscosity change) of ink between the initial stage and later stages of the operation, may make it easy to cause, for example, so-called broke or prints which cannot be used as products in the initial stage of the printing operation.

In a conventional printing press, prior to starting the printing operation, a given operational mode adapted such as for maintenance, trouble repair or more specifically cleaning of an ink fountain roller is selected so that the ink fountain roller is rotated for a given time (e.g., several ten minutes) with the ink fountain keys being held at a given distance from the ink fountain roller or, for example, being opened to the maximum so as to knead ink in the ink fountain by the rotation of the ink fountain roller, thereby allowing the viscosity of the ink to be the same level as the viscosity of ink attained in the later stages of the printing operation. Thus, the printing operation is started.

In order to further improve an ink kneading effect produced by the rotation of the ink fountain roller, additional ink kneading is sometimes made manually by an operator using a paddle-like tool or the like, or by an ink kneading unit that is provided independently of the printing press. This unit is equipped such as with a rotary stirrer having a circular-cone shape that is disposed to be movable in a direction parallel to the axis of the ink fountain roller relative to the ink fountain, in which the rotary stirrer is rotated in the ink fountain as it is moved in the direction parallel to the axis of the ink fountain roller.

The above conventional kneading operation, which is made additionally for the improvement of the kneading effect by the rotation of the ink fountain roller, increases the operator's workload to manually knead ink in the ink fountain, or wash the stirrer of the kneading unit after the kneading operation. Whether the kneading operation is made manually or automatically, the operator's workload is increased. As a further disadvantage in providing an ink kneading unit, the cost of the printing press is increased due to the additional arrangement of the ink kneading unit.

In consideration of the above problems, it is an object of the present invention to provide a method of kneading ink of a printing press and a printing press that are capable of reducing the operator's workload and holding down the cost of the printing press.

SUMMARY OF THE INVENTION

According to one aspect of the present invention, there is provided a method of kneading ink stored in an ink fountain of a printing press, in which an ink fountain roller rotates so as to make ink adhere to a circumference thereof and feed ink therefrom to a downstream roller (e.g., an ink transfer roller), at least one ink fountain key that is aligned in a first direction parallel to the axis of the ink fountain roller and disposed so as to be moved back and forth in a second direction orthogonal to the first direction, thereby allowing each of the at least one ink fountain key and the ink fountain roller to have a predetermined gap therebetween and hence the amount of ink to be fed to the downstream roller (the amount of ink for adjustment of an image quality of prints) to be determined. The method includes rotating the ink fountain roller while preventing ink from being fed to the downstream roller, and moving at least one of the at least one ink fountain key in the second direction during the rotation of the ink fountain roller so as to allow the at least one of the at least one ink fountain key to change a position thereof relative to the ink fountain roller of the ink fountain with time.

According to another aspect of the present invention, there is provided a printing press comprising: an ink fountain for storing ink; an ink fountain roller that rotates so as to make ink adhere to a circumference thereof and feed ink therefrom to a downstream roller (e.g., an ink transfer roller); a roller positioning unit that moves at least one of the ink fountain roller and the downstream roller so as to allow the both rollers to be selectively held close to each other and away from each other; a roller driving unit that rotates the ink fountain roller; at least one ink fountain key that is aligned in a first direction parallel to the axis of the ink fountain roller and disposed to be movable in a second direction orthogonal to the first direction; an ink-fountain-key moving unit that moves each of the at least one ink fountain key in the second direction, thereby determining the amount of ink (the amount of ink for adjustment of an image quality of prints) to be fed to the downstream roller; and a control part that controls the roller positioning unit, the roller driving unit and the ink-fountain-key moving unit so as to rotate the ink fountain roller while preventing ink from being fed to the downstream roller, moving at least one of the at least one ink fountain key in the second direction during the rotation of the ink fountain roller, thereby allowing the at least one of the at least one ink fountain key to change a position thereof relative to the ink fountain roller of the ink fountain with time.

According to the present invention, by change with time is meant to include intermittent change with a given time interval, successive change or cyclic change.

In the method and apparatus of the present invention, the ink fountain roller is rotated while ink of the ink fountain is prevented from being fed to the downstream roller, and at least one of the at least one ink fountain key is moved in the second direction so as to allow the at least one of the at least one ink fountain key to change a position thereof relative to the ink fountain roller of the ink fountain with time. As a result, the operator is not required to manually knead ink in the ink fountain, and any device or unit for kneading printing ink to be provided independently of the printing press is also not required.

With the above method and printing press, in addition to a kneading effect provided by kneading printing ink in the ink fountain by the rotation of ink fountain roller in a circumferential direction of the roller, another kneading effect can be produced. That is, the change in position of the at least one ink fountain key relative to the ink fountain key with time causes ink in the ink fountain to be kneaded in the second direction. Furthermore, the positional change of the at least one ink fountain key causes a gap between each of the at least one ink fountain key and the ink fountain roller to be changed and hence the amount of ink, which has adhered to the circumference of the ink fountain roller so as to be rotated therewith, to be varied. This variation in the amount of ink on the ink fountain roller causes ink mainly around the ink fountain roller to be kneaded in the radial direction of the ink fountain roller. These ink kneading effects by the change in the position of the at least one ink fountain key and the variation in the amount of ink on the circumference of the ink fountain roller achieve more effective kneading of ink in the ink fountain in combination with the above kneading effect by the rotation of the ink fountain roller.

The above ink kneading operation is preferably performed prior to the start of the printing operation, or prior to the determination of the amount of ink to be fed. For the kneading operation, it is possible to first take a measure to prevent ink from being fed to the downstream roller, then rotate the ink fountain roller and then move the at least one ink fountain key in the second direction. Or, it is possible to first take a measure to prevent ink from being fed to the downstream roller, then move the at least one ink fountain key in the second direction and then rotate the ink fountain roller. In either case, the position of each of the at least one ink fountain key relative to the ink fountain roller of the ink fountain can be changed with time during the rotation of the ink fountain roller.

A moving distance between a minimum point at which the gap between each of the at least one ink fountain key and the ink fountain roller becomes minimum and a maximum point at which this gap becomes maximum is preferably set to be great. While the moving distance is not necessarily limited to a specific distance, it can be cited for example 0.1 mm–1.0 mm. This range is not meant to be limited to the range of the moving distance through which the amount of ink to be fed is determined, and therefore can be set wider than such range. As the minimum point and the maximum point, it can be cited about 0 mm and about 1.0 mm, respectively. As the peripheral speed of the ink fountain roller, it can be cited about 10 mm/sec–200 mm/sec, while not being necessarily limited thereto.

In a printing press of the present invention, the control part may be provided with a timer means that allows the roller driving unit and the ink-fountain-key moving unit to perform the ink kneading operation for a predetermined time period. This timer means may be in such a form as to allow an operator to select one of plural time periods set in increments of given time (e.g., increments of 5 minutes from 5 minutes to 60 minutes).

According to the present invention, various embodiments of the kneading method and the printing press such as those described below may be made.

(a1) 1st Embodiment of Ink Kneading Method

While preventing ink from being fed to the downstream roller, the ink fountain roller is rotated, and the at least one ink fountain key is substantially simultaneously moved to the same position or substantially the same position relative to the ink fountain roller, thereby allowing the at least one ink fountain key to change its reached position, for example, regularly in a given cycle.

(a2) 1st Embodiment of Printing Press

The control part controls the roller positioning unit, the roller driving unit and the ink-fountain-key moving unit so as to rotate the ink fountain key while preventing ink from being fed to the downstream roller, and substantially simultaneously move the at least one ink fountain key to the same position or substantially the same position relative to the ink fountain roller, thereby allowing the at least one ink fountain key to change its reached position, for example, regularly in a given cycle.

In the above embodiments (a1) and (a2), another kneading effect in addition to the kneading effect produced by kneading ink in the circumferential direction by the rotation of the ink fountain roller can be produced. That is, since the at least one ink fountain key is substantially simultaneously moved to the same or substantially the same position relative to the ink fountain roller, thereby allowing the at least one ink fountain key to change its reached position, for example, regularly in a given cycle, ink in the ink fountain is kneaded in the second direction by the change in position of the ink fountain key. Furthermore, this positional change causes the gap between each of the at least one ink fountain key and the ink fountain roller to be changed so that the amount of ink, which has adhered to the circumference of the ink fountain roller so as to be rotated therewith, is varied. This variation in the amount of ink on the ink fountain roller causes ink mainly around the ink fountain roller to be kneaded in the radial direction of the ink fountain roller. Accordingly, the ink kneading effects produced by the change in the position of the at least one ink fountain key and variation in the amount of ink on the circumference of the ink fountain roller achieve more effective kneading of ink in the ink fountain in combination with the kneading effect produced by kneading ink in the ink fountain by the rotation of the ink fountain roller.

(b1) 2nd Embodiment of Ink Kneading Method

The at least one ink fountain key in the printing press comprises 1st to nth (n is an integer of 2 or larger) ink fountain keys that are aligned in the first direction and disposed so as to be movable in the second direction. While preventing ink from being fed to the downstream roller, the ink fountain roller is rotated. An odd numbered ink fountain key of the 1st to nth ink fountain keys is moved so as to allow the odd numbered ink fountain key to reach substantially simultaneously the same position or substantially the same position relative to the ink fountain roller during the rotation of the ink fountain roller, and an even numbered ink fountain key of the 1st to nth ink fountain keys is moved so as to allow the even numbered ink key to reach substantially simultaneously the same position or substantially the same position relative to the ink fountain roller during the rotation of the ink fountain roller, thereby allowing both the odd numbered ink fountain key and the even numbered ink fountain key to alternately change the reached positions thereof with time, for example, regularly in a given cycle.

(b2) 2nd Embodiment of Printing Press

The at least one ink fountain key in the printing press comprises 1st to nth (n is an integer of 2 or larger) ink fountain keys that are aligned in the first direction and disposed so as to be movable in the second direction. The control part controls the roller positioning unit, the roller driving unit and the ink-fountain-key moving unit so as to rotate the ink fountain roller while preventing ink from being fed to the downstream roller, and move an odd numbered ink fountain key of the 1st to nth ink fountain keys so as to allow the odd numbered ink fountain key to reach substantially simultaneously the same position or substantially the same position relative to the ink fountain roller during the rotation of the ink fountain roller, and move an even numbered ink fountain key of the 1st to nth ink fountain keys so as to allow the even numbered ink key to reach substantially simultaneously the same position or substantially the same position relative to the ink fountain roller during the rotation of the ink fountain roller; thereby allowing both the odd numbered ink fountain key and the even numbered ink fountain key to alternately change the reached positions thereof with time, for example, regularly in a given cycle.

In the above embodiments (b1) and (b2), in addition to the kneading of ink by the rotation of the ink fountain roller in the circumferential direction, ink is kneaded in the second direction because the odd numbered ink fountain key and the even numbered ink fountain key each substantially simultaneously reach the same position or substantially the same position relative to the ink fountain roller, thereby allowing both the odd numbered ink fountain key and the even numbered ink fountain key to alternately change the reached positions thereof with time, for example, regularly in a given cycle. Also, because the ink fountain keys adjacent to each other are alternately moved, ink mainly around these alternately moving adjacent ink fountain keys are kneaded by this alternate movement of the adjacent ink fountain keys. Furthermore, the change in the positions of the ink fountain keys causes the change in gap between the odd numbered ink fountain key and the even numbered ink fountain key each and the ink fountain roller, and hence the variation in the amount of ink which has adhered to the ink fountain roller so as to be rotated therewith. This variation in the amount of ink on the ink fountain roller causes ink mainly around the ink fountain roller to be kneaded in the radial direction of the ink fountain roller. In this case, in addition to the kneading effect by kneading ink in the ink fountain by the rotation of the ink fountain roller, an ink kneading effect by the positional changes of the odd and even numbered ink fountain keys, an ink kneading effect by the alternate moving of the adjacent ink fountain keys and an ink kneading effect by the variation in the amount of ink on the ink fountain roller are combined together. As a result, ink in the ink fountain can be more effectively kneaded.

(c1) 3rd Embodiment of Ink Kneading Method

The at least one ink fountain key in the printing press comprises 1st to nth (n is an integer of 2 or larger) ink fountain keys that are aligned in the first direction and disposed so as to be movable in the second direction. While preventing ink from being fed to the downstream roller, the ink fountain roller is rotated. Of the 1st to nth ink fountain keys, 1st to mth ink-fountain-key groups (m is an integer of 2 or larger but smaller than n) each comprising one ink fountain key or two or more ink fountain keys adjacent to each other are moved so that the one ink fountain key or two or more ink fountain keys adjacent to each other of each group reach substantially simultaneously the same position or substantially the same position relative to the ink fountain roller, thereby allowing the 1st to mth ink-fountain-key groups to respectively and sequentially change the reached positions thereof with a predetermined time lag, such as forming a wave-like pattern in a given cycle.

(c2) 3rd Embodiment of Printing Press

The at least one ink fountain key in the printing press comprises 1st to nth (n is an integer of 2 or larger) ink fountain keys that are aligned in the first direction and disposed so as to be movable in the second direction. The control part controls the roller positioning unit, the roller driving unit and the ink-fountain-key moving unit so as to rotate the ink fountain key while preventing ink from being fed to the downstream roller, and move, of the 1st to nth ink fountain keys, 1st to mth ink-fountain-key groups (m is an integer of 2 or larger but smaller than n) each comprising one ink fountain key or two or more ink fountain keys adjacent to each other, so that the one ink fountain key or two or more ink fountain keys adjacent to each other of each group reach substantially simultaneously the same position or substantially the same position relative to the ink fountain roller, thereby allowing the 1st to mth ink-fountain-key groups to respectively and sequentially change the reached positions thereof with a predetermined time lag, such as forming a wave-like pattern in a given cycle.

In the above embodiments (c1) and (c2), in addition to the kneading effect produced by kneading ink by the rotation of the ink fountain roller in the circumferential direction of the roller, another kneading is produced. That is, with the arrangement in which the one ink fountain key or two or more ink fountain keys adjacent to each other of each of the 1st to mth ink-fountain-key groups reach substantially simultaneously reach the same position or substantially the same position relative to the ink fountain roller, and the 1st to mth ink-fountain-key groups respectively and sequentially change the reached positions thereof with a predetermined time lag, with time, for example, regularly in a given cycle, ink in the ink fountain is kneaded in the second direction by the effect produced by the change in position of the 1st to mth ink fountain key groups. Furthermore, the movement of the adjacent ink-fountain-key groups with a predetermined time lag, such as forming a wave-like pattern causes ink mainly around the adjacent ink-fountain-key-groups to be kneaded through the relative movement of these adjacent ink-fountain-key groups. And still furthermore, with the positional change of these ink-fountain-key groups, the gap between the ink fountain roller and each of the 1st to mth ink-fountain-key groups is changed. This change causes variation in the amount of ink adhered to the circumference of the ink fountain roller and rotated therewith, and hence ink mainly around the ink fountain roller to be kneaded through the effect produced by the variation in the amount of ink on the circumference of the ink fountain roller. In this case, the ink kneading effects produced by the change in the position of the 1st to mth ink-fountain-key groups, the relative movement of the adjacent ink-fountain-key groups, and variation in the amount of ink on the circumference of the ink fountain roller achieve more effective kneading of ink in the ink fountain in combination with the kneading effect produced by kneading ink in the ink fountain by the rotation of the ink fountain roller.

In any one of the embodiments (a1)–(c1), and (a2)–(c2), in a case where, for example, the ink fountain keys are moved regularly in a given cycle, they may be moved about 1–5 times every minute, while the given cycle is not necessarily limited thereto.

According to various embodiments of the present invention applicable to a method and printing press, an ink fountain roller rotates so as to make ink adhere to a circumference thereof and feed ink therefrom to a downstream roller, at least one ink fountain key that is aligned in a first direction parallel to the axis of the ink fountain roller and disposed so as to be moved back and forth in a second direction orthogonal to the first direction, thereby allowing the at least one ink fountain key and the ink fountain roller to have a predetermined gap therebetween and hence the amount of ink to be fed to the downstream roller to be determined. As a result, in addition to the kneading effect produced by the rotation of the ink fountain roller, an ink kneading effect can be further improved without the necessity to manually knead ink in the ink fountain by the operator and without the necessity to provide any device or unit independently of the printing press. As a result, it is possible to provide a method of kneading ink of a printing press and a printing press that are capable of reducing the operator's workload and holding down the cost of the printing press.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
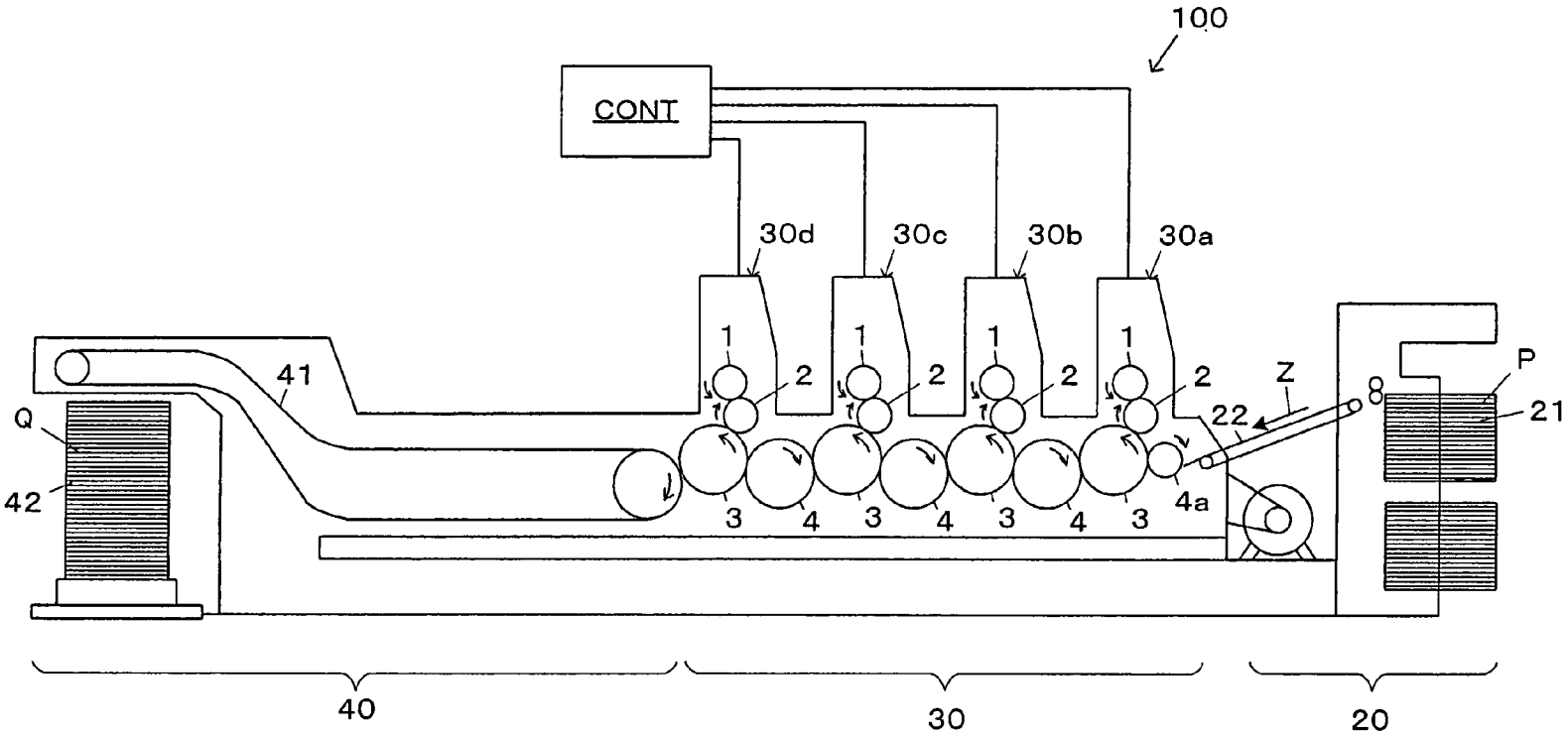
FIG. 1 is a schematic view of a printing press according to one embodiment of the present invention, which carries out a kneading method of the present invention.

Now, the description will be made for the embodiments of the present invention with reference to the drawings attached hereto. FIG. 1 a schematic view of a printing press according to one embodiment of the present invention, which carries out a kneading method of the present invention. In this Figure, the same reference codes are allocated to parts or members having substantially the same structure and function.

A printing press 100 of FIG. 1 includes a sheet feeding section 20, a printing section 30, a sheet discharge section 40 and a control part CONT. The sheet feeding section 20 is designed to be capable of feeding subjects P (herein, sheets of paper or simply referred to sheets) to the printing section 30. The printing section 30 is designed to be capable of printing on sheets P fed from the sheet feeding section 20 and includes plural printing units (herein, four printing units 30*a*–30*d*). The sheet discharge section 40 is designed to be capable of discharging printed sheets (hereinafter simply referred to prints) Q. In this printing press 100, sheets P fed from the sheet feeding section 20 are printed at the printing units 30*a*–30*d*, and the prints Q are discharged through the sheet discharge section 40.

The sheet feeding section 20 includes a storage part 21 and a feeding part 22. The storage part 21 is designed to be capable of storing plural sheets P, while the feeding part 22 is designed to be capable of extracting sheets P one by one from a supply stack of sheets stored in the storage part 21 and transferring the same towards the printing section 30. Whereby, sheets P are fed to the printing section 30.

The printing units 30*a*–30*d* of the printing section 30 each are made up of several main components, namely a plate cylinder 1, a rubber cylinder 2 and an impression cylinder 3. A reference code 4*a* in the printing unit 30*a* and reference codes 4 in the printing units 30*b*–30*d* respectively represent transfer cylinders.

The plate cylinder 1 in each of the printing units 30*a*–30*d* has a printing plate (not illustrated), to which ink and water are fed, so that ink is transferred onto the rubber cylinder 2 according to the movement of the printing plate. Ink transferred onto the rubber cylinder 2 is further transferred onto oncoming sheets P fed by the rubber cylinder 2 and the impression cylinder 3 that together clamp sheets P. Whereby, prints corresponding to printing plates respectively mounted on the plate cylinders are made for the sheets P fed from the sheet feeding section 20.

The printing units 30*a*–30*d* print a color image on sheets P with four printing inks, namely black (K), cyan (C), magenta (M) and yellow (Y). The printing section 30 thus prints a color image comprising different basic colors (herein, four colors, namely black (K), cyan (C), magenta (M) and yellow (Y)) on each sheet P.

The sheet discharge section 40 includes a transfer part 41 and a stock part 42. In this sheet discharging section 40, prints Q transferred through the impression cylinder 3 of the printing unit 30*d* are transferred along a bottom side (not shown) of the transfer part 41 into the stock part 42 with its leading end of each print held by a holding member (not shown) of the transfer part 41. The stock part 42 is designed to be capable of storing prints Q transferred thereinto by the transfer part 41.

Figure 2:
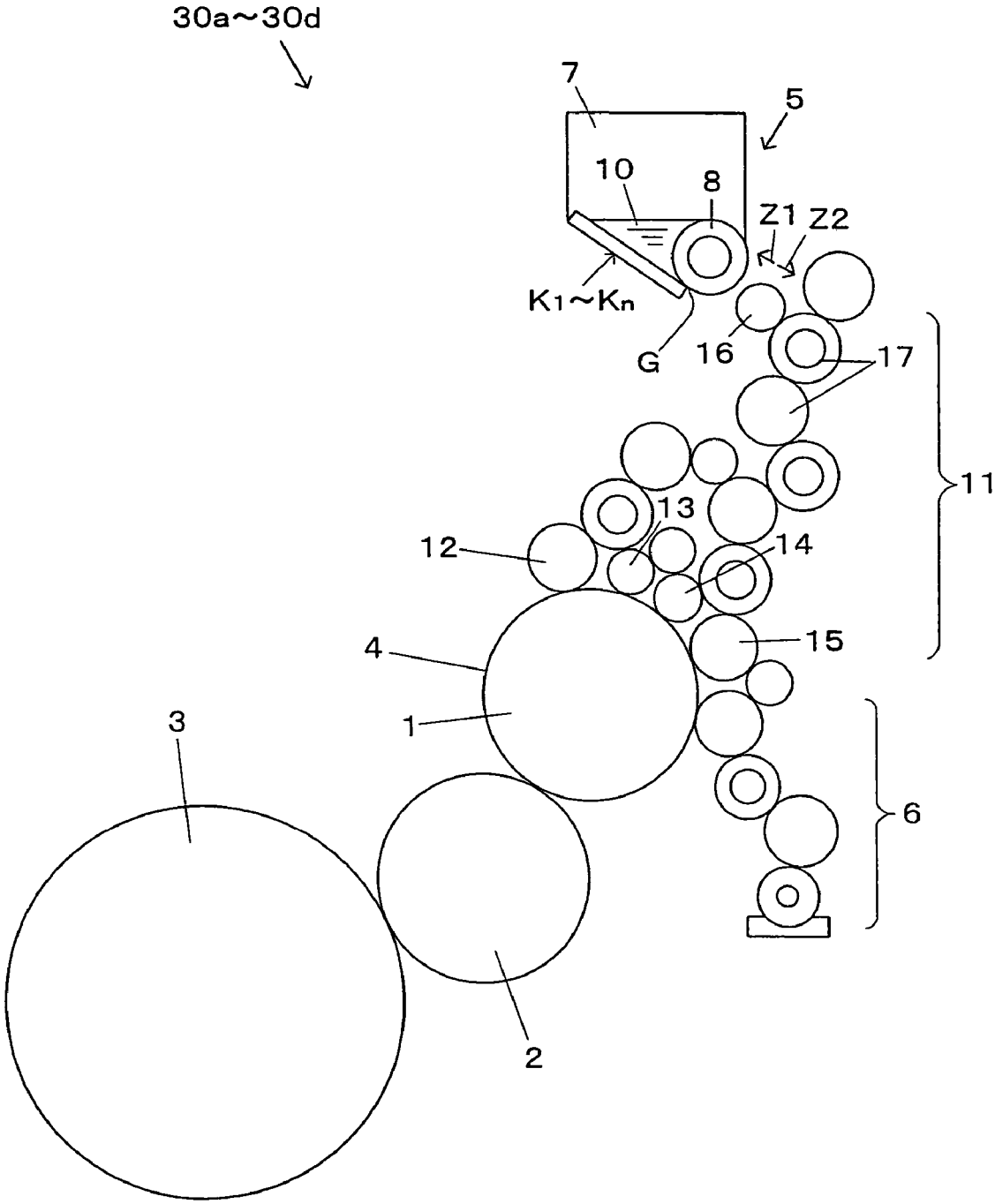
FIG. 2 is a side elevational view of an essential portion of each printing unit in a printing section illustrated in FIG. 1.

FIG. 2 is a side elevational view of an essential portion of each of the printing units 30*a*–30*d* in the printing section 30 illustrated in FIG. 1. The printing units 30*a*–30*d* have substantially the same structure and therefore only one of them is illustrated in FIG. 2.

In each of the printing units 30*a*–30*d*, sheets P are printed during they are passed between the impression cylinder 3 and the rubber cylinder 2.

Each of the printing units 30*a*–30*d* further includes an ink supply unit 5, a pivotally moving unit 70 as an example of a roller positioning unit (not shown in FIG. 2, see FIG. 3A referred later), a group of ink rollers 11 and a water supply unit 6, in addition to the plate cylinder 1, the rubber cylinder 2 and the impression cylinder 3. The ink supply unit 5 is designed to be capable of supplying ink 10 to the group of ink rollers 11. The group of ink rollers 11 are designed to be capable of feeding ink 10 supplied from the ink supply unit 5 onto the printing plate 4 of the plate cylinder 1. The water supply unit 6 is designed to be capable of supplying water onto the printing plate 4.

Figure 3A:
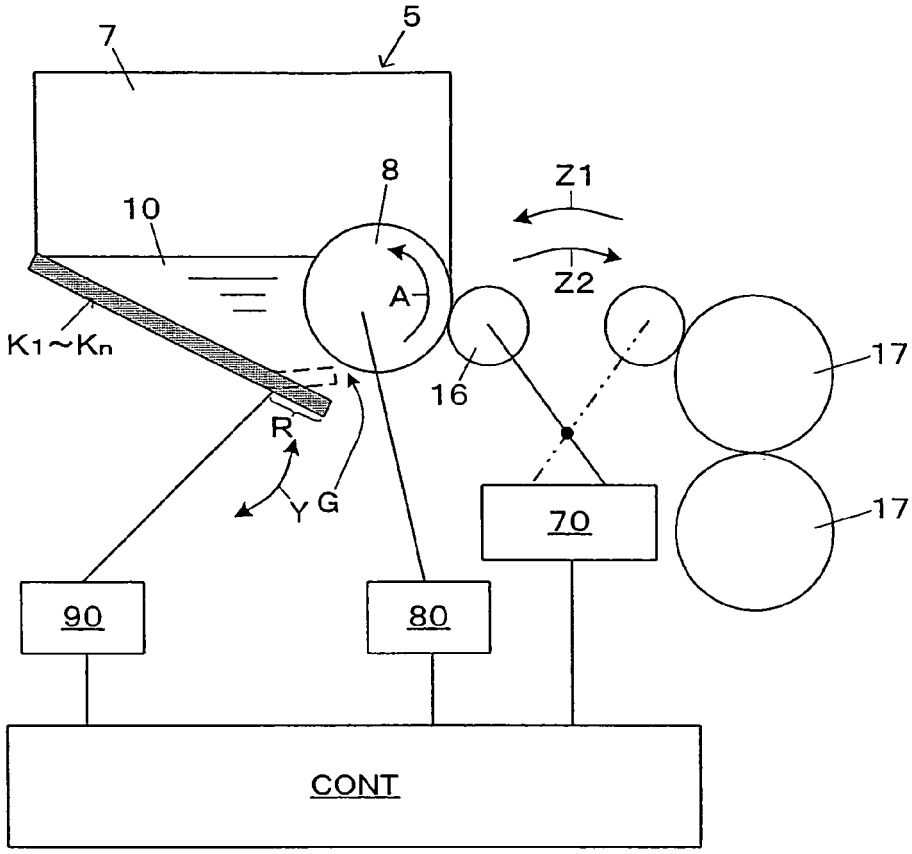
FIG. 3A is a model view with an essential portion and its periphery of an ink supply unit enlarged.
Figure 3B:
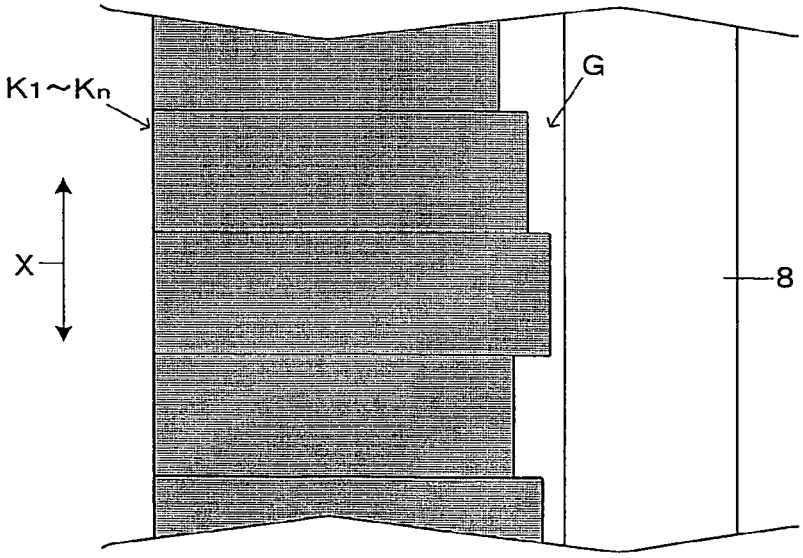
FIG. 3B is a partial model view with variation in gap between each ink fountain key and an ink fountain roller of the ink supply unit illustrated in an exaggerated manner.

FIG. 3A is a model view with an essential portion and its periphery, of the ink supply unit 5, and FIG. 3B is a partial model view with variation in gap G between each of ink fountain keys $K_1$–$K_n$ (n is an integer of 2 or larger) in the ink supply unit 5 and an ink fountain roller 8 illustrated in an exaggerated manner. The ink fountain keys $K_1$–$K_n$ will be later described.

As illustrated in FIG. 3A, the ink supply unit 5 includes an ink fountain 7, an ink fountain roller 8, the ink fountain keys $K_1$–$K_n$, a roller driving unit 80 and an ink-fountain-key moving unit 90.

The ink fountain 7 is capable of storing ink 10 and is provided with the ink fountain roller 8 and the ink fountain keys $K_1$–$K_n$. The ink fountain roller 8 is rotatably disposed at a bottom of the ink fountain 7 and connected to the roller driving unit 80. The roller driving unit 80 is connected to the control part CONT so as to rotate the ink fountain roller 8 in a given direction (an anticlockwise direction A represented by an arrow in FIG. 3A) under the control of the control part CONT. With this arrangement, the ink fountain roller 8 has ink 10 of the ink fountain 7 adhered thereon upon its rotation, thereby allowing ink 10 on the circumference of the ink fountain roller 8 to be fed to a downstream roller (an ink transfer roller 16 in this embodiment). The peripheral speed of the ink fountain roller 8 is herein about 10 mm/sec–200 mm/sec. For the roller driving unit 80, known mechanisms are applicable, as long as they can rotate the ink fountain roller 8. Accordingly, no detailed description for it will be made herein.

The ink fountain keys $K_1$–$K_n$ are aligned in a first direction (a direction represented by an arrow X in FIG. 3B) parallel to the axis of the ink fountain roller 8 so as to be movable back and forth in a second direction (a direction represented by an arrow Y in FIG. 3A) orthogonal to the first direction. In more detail, the ink fountain keys $K_1$–$K_n$ each comprise a flexible plate-like member and supported at its one end by a support member (not shown) with an end portion R close to the ink fountain roller 8 held open. These open ends R of the ink fountain keys $K_1$–$K_n$ are connected to the ink-fountain-key moving unit 90. The ink-fountain-key moving unit 90 is connected to the control part CONT so that the open ends R of the ink fountain keys $K_1$–$K_n$ can be moved in the second direction Y under the control of the control part CONT. The ink fountain keys $K_1$–$K_n$ each may comprise a non-flexible plate-like member and allow ends opposite to the open ends R to be pushed and pulled, thereby allowing each of the ink fountain keys $K_1$–$K_n$ and the ink fountain roller 8 to have a predetermined gap ("G" in FIG. 3B) therebetween and hence the amount of ink to be fed to the ink transfer roller 16 to be determined. The moving distance between a minimum point at which the gap G between each of the ink fountain keys $K_1$–$K_n$ and the ink fountain roller 8 becomes minimum and a maximum point at which this gap G becomes maximum is for example about 0.1 mm–1.0 mm, in which the minimum and maximum points lie respectively at about 0 mm and about 1.0 mm from a certain point. The ink-fountain-key moving unit 90 may employ various known mechanisms, as long as they can move the ink fountain keys $K_1$–$K_n$ in the second direction Y. Herein, the detailed description for the structure or the like thereof will be thus omitted.

In the ink supply unit 5 as illustrated in FIGS. 2 and 3, ink 10 stored in the ink fountain 7 flows through the gap G between the ink fountain roller 8 and each of the ink fountain keys $K_1$–$K_n$ and fed onto the circumference of the ink fountain roller 8 when it is rotated. The gap G is adjustable by moving each of the ink fountain keys $K_1$–$K_n$ in the second direction Y by the ink-fountain-key moving unit 90 under the control of the control part CONT, so that when the opening degree of each of the ink fountain keys $K_1$–$K_n$ is increased, the gap G is widened and the amount of ink fed out of the ink fountain 7 is accordingly increased, and when the opening degree of each of the ink fountain keys $K_1$–$K_n$ is decreased, the gap G is narrowed and the amount of ink fed out of the ink fountain 7 is accordingly decreased.

As illustrated in FIG. 2, ink flowing out of the ink fountain 7 and fed onto the ink fountain roller 8 is fed onto the printing plate 4 via the group of ink rollers 11 comprising a number of rollers 12–17. The group of ink rollers 11 are disposed parallel to the ink fountain roller 8, the plate cylinder 1 and the like, and disposed adjacent to each other so as to subsequently transfer ink from the upstream one to the downstream one. Specifically, the inking rollers 12, 13, 14 and 15 for distributing ink from the ink fountain 7 to the plate cylinder 1 are disposed on the most downstream side, while the ink transfer roller 16 is disposed on the most upstream side. A number of ink rollers 17 are disposed therebetween.

The ink transfer roller 16 is disposed so as to be movable back and forth between the ink fountain roller 8 and the ink rollers 17, and is connected to the pivotally moving unit 70, as illustrated in FIG. 3A. The pivotally moving unit 70 is connected to the control part CONT so that the ink transfer roller 16 is selectively moved closer to the ink fountain roller 8 and moved away from the ink fountain roller 8 toward the ink rollers 17 under the control of the control part CONT.

With this arrangement, the ink transfer roller 16 is moved back and forth between the ink fountain roller 8 and the ink rollers 17 in the two directions represented by arrows Z1, Z2 in FIG. 3A in a given cycle. This reciprocal movement allows ink to be fed onto the ink transfer roller 16 when it moves closer to the ink fountain roller 8 and ink fed onto the ink transfer roller 16 to be in turn fed onto the most upstream ink roller 17 when the ink transfer roller 16 moves closer to the ink rollers 17. Thus, ink adhered to the circumference of the ink fountain roller 8 is transferred to the ink rollers 17. The pivotally moving unit 70 may employ various known mechanisms, as long as they can selectively move the ink transfer roller 16 to given positions, as described above. Accordingly, no detailed description for it will be made herein.

Thus, ink 10 in the ink fountain 7 is transferred through the ink fountain roller 8, the ink transfer roller 16 and the ink rollers 17 to the inking rollers 12, 13, 14, 15, and then fed onto the printing plate 4 by these inking rollers 12, 13, 14, 15.

Figure 4:
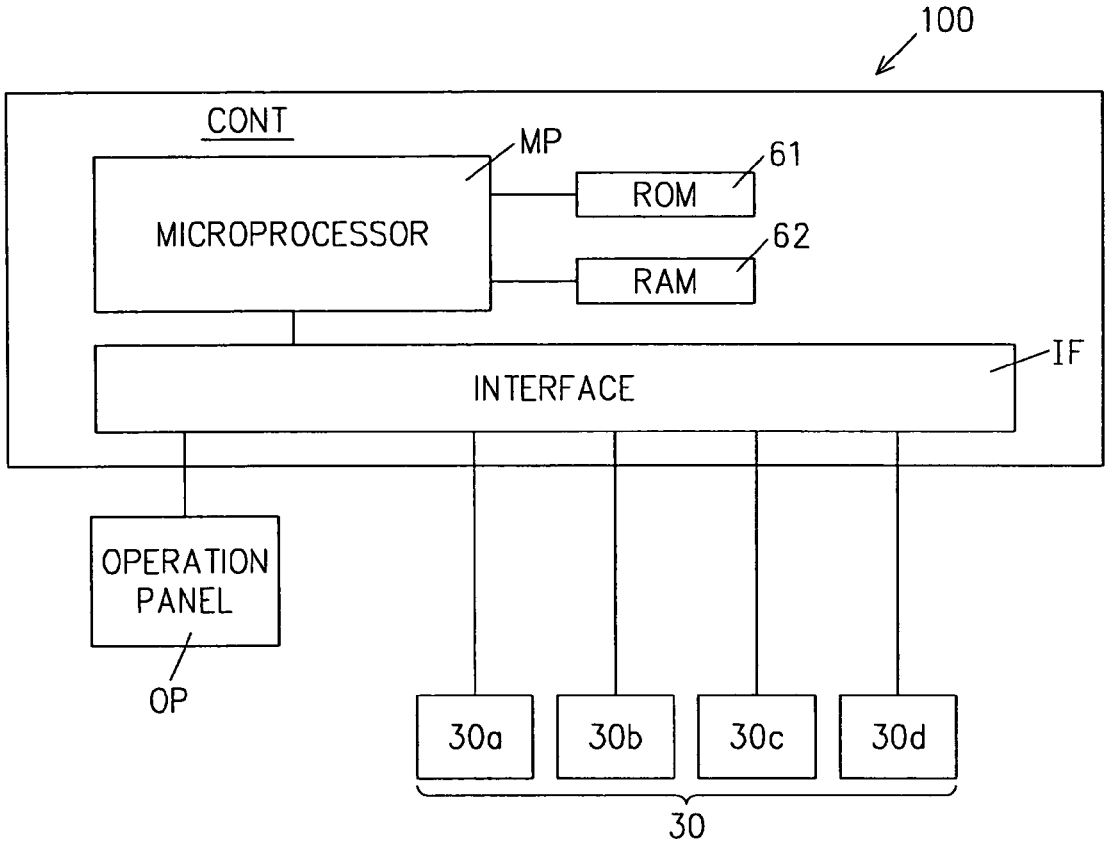
FIG. 4 is a block view illustrating a schematic arrangement of the printing press of FIG. 1, in which a control part is centrally illustrated.

FIG. 4 is a block view illustrating a schematic arrangement of the printing press 100 of FIG. 1, in which the control part CONT is centrally illustrated. The control part CONT is to control the entire operation of the printing press 100 and includes a means enabling controlling the ink-fountain-key moving unit 90 so that, for example, each of the ink fountain keys $K_1$–$K_n$ is moved in the second direction Y so as to have a predetermined gap G relative to the ink fountain roller 8. With this control part CONT, the opening degree of each of the ink fountain keys $K_1$–$K_n$ is set according to the image area ratio of the printing plate 4 before starting the printing operation. This image area ratio is evenly divided in the widthwise direction of the printing plate into zones respectively corresponding to the ink fountain keys $K_1$–$K_n$ and the image area ratio of each zone is measured to provide image area ratio data for each zone that is converted into opening degree data for each of the ink fountain keys $K_1$–$K_n$, thereby setting the opening degree of each of the ink fountain keys $K_1$–$K_n$ based on this opening degree data.

This control part CONT includes a ROM 61 that stores such as programs required for processing printing operation and data required for control and calculation, a microprocessor MP that reads out data from the ROM 61 and processes the same, a RAM 62 that temporarily stores data required for the operation of the microprocessor MP, and an interface IF that inputs data into the microprocessor MP and outputs data therefrom. An operation panel OP for inputting the information required for the printing operation, operational information and the like, the printing units 30*a*–30*d* and the like are connected to the control part CONT.

The control part CONT also has an ink kneading function to knead ink in the ink fountain by moving the ink fountain keys while rotating the ink fountain key, prior to the printing operation. This ink kneading function is achieved through a part of the programs that makes the microprocessor MP act as an ink-transfer-roller pivotally moving means, an ink-fountain-roller driving means, an ink-fountain-key moving means and a timer means, which will all be hereinafter referred.

The ink-transfer-roller pivotally moving means controls the pivotally moving unit 70 so as to move the ink transfer roller 16 towards the ink fountain roller 8 or away from the same towards the ink roller 17. The ink-fountain-roller driving means controls the roller driving unit 80 so as to rotate the ink fountain roller 8.

Figure 5A:
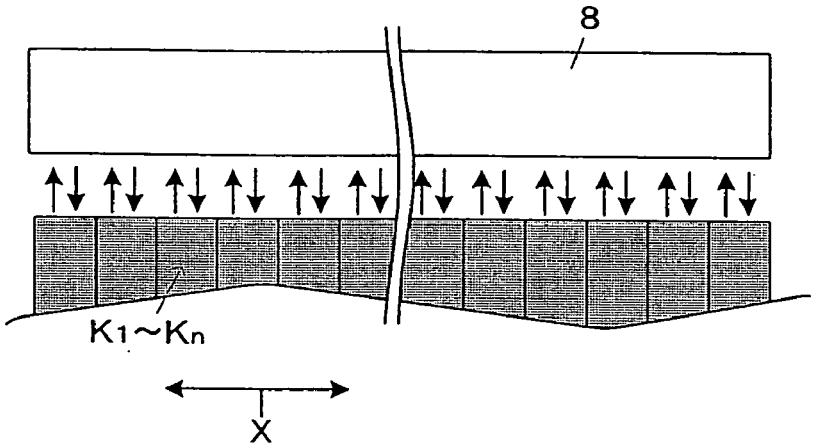
FIG. 5A is a view for explanation of a method and printing press in a first embodiment, according to the present invention.

The ink-fountain-key moving means controls the ink-fountain-key moving unit 90 so as to move at least one of the ink fountain keys $K_1$–$K_n$ in the second direction Y and hence change the position of the same relative to the ink fountain roller 8 with time. This control will be more specifically described with reference to FIGS. 5A–5C. The control part CONT performs any one of the following controls for the ink-fountain-key moving unit 90:

(a) Control the ink-fountain-key moving unit 90 so as to move the ink fountain keys $K_1$–$K_n$, as illustrated in FIG. 5A, so that they reach substantially simultaneously the same position or substantially the same position relative to the ink fountain roller 8, thereby allowing the ink fountain keys $K_1$–$K_n$ to regularly change the reached positions thereof in a given cycle (e.g., 1–5 times every minute).

Figure 5B:
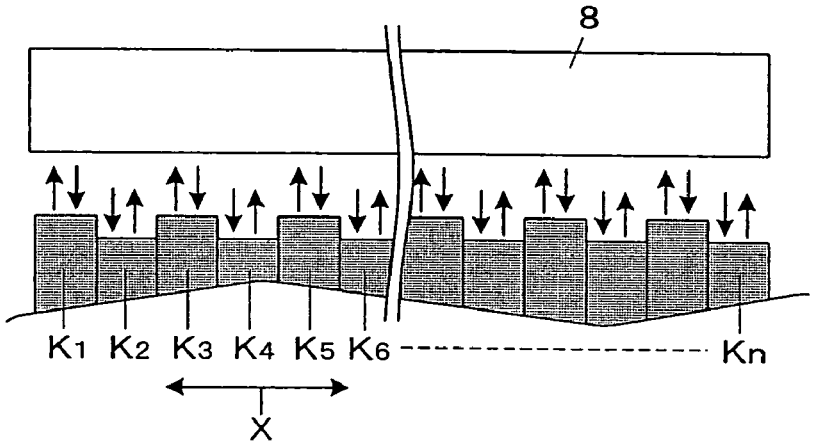
FIG. 5B is a view for explanation of the method and printing press in a second embodiment, according to the present invention.

(b) Control the ink-fountain-key moving unit 90 so as to move the odd numbered ink fountain keys $K_1$, $K_3$ . . . of the 1st to nth ink fountain keys $K_1$–$K_n$, as illustrated in FIG. 5B, so that they reach substantially simultaneously the same position or substantially the same position relative to the ink fountain roller 8, while move the even numbered ink fountain keys $K_2$, $K_4$ . . . so that they reach substantially simultaneously the same position or substantially the same position relative to the ink fountain roller 8, thereby allowing both the odd numbered ink fountain keys and the even numbered ink fountain keys to alternately and regularly change the reached positions thereof in a given cycle (e.g., 1–5 times every minute).

Figure 5C:
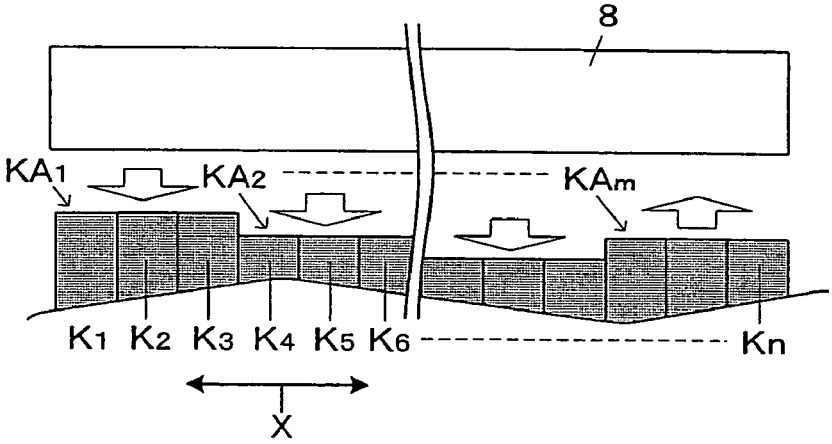
FIG. 5C is a view for explanation of the method and printing press in a third embodiment, according to the present invention.

(c) Control the ink-fountain-key moving unit 90 so as to move 1st to mth ink-fountain-key groups $KA_1$–$KA_m$ (m is an integer of 2 or larger but smaller than n) each comprising predetermined three ink fountain keys ($K_1$, $K_2$, $K_3$), ($K_4$, $K_5$, $K_6$), . . . of the 1st to nth ink fountain keys $K_1$–$K_n$, as illustrated in FIG. 5C, so that three adjacent ink fountain keys of each of the 1st to mth ink-fountain-key groups $KA_1$–$KA_m$ reach substantially simultaneously the same position or substantially the same position relative to the ink fountain roller 8, thereby allowing the 1st to mth ink-fountain-key groups $KA_1$–$KA_m$ to change sequentially the reached positions thereof respectively with a predetermined time lag, thus forming a wave-like pattern in a given cycle (e.g., 1–5 times every minute). The controls in the above items (a)–(c) are determined through selection by an operator using the operational panel OP.

The timer means has a timer function that allows the roller driving unit 80 and the ink-fountain-key moving unit 90 to perform the ink kneading operation for a predetermined time period. With this timer function, the ink kneading operation is continued for a predetermined time period by the roller driving unit 80 and the ink-fountain-key moving unit 90. This predetermined time period is determined by an operator who selects the time period which is for example displayed on the operational panel in such a manner to be selectable in increments of 5 minutes from 5 minutes to 60 minutes, before starting the ink kneading operation.

Figure 6:
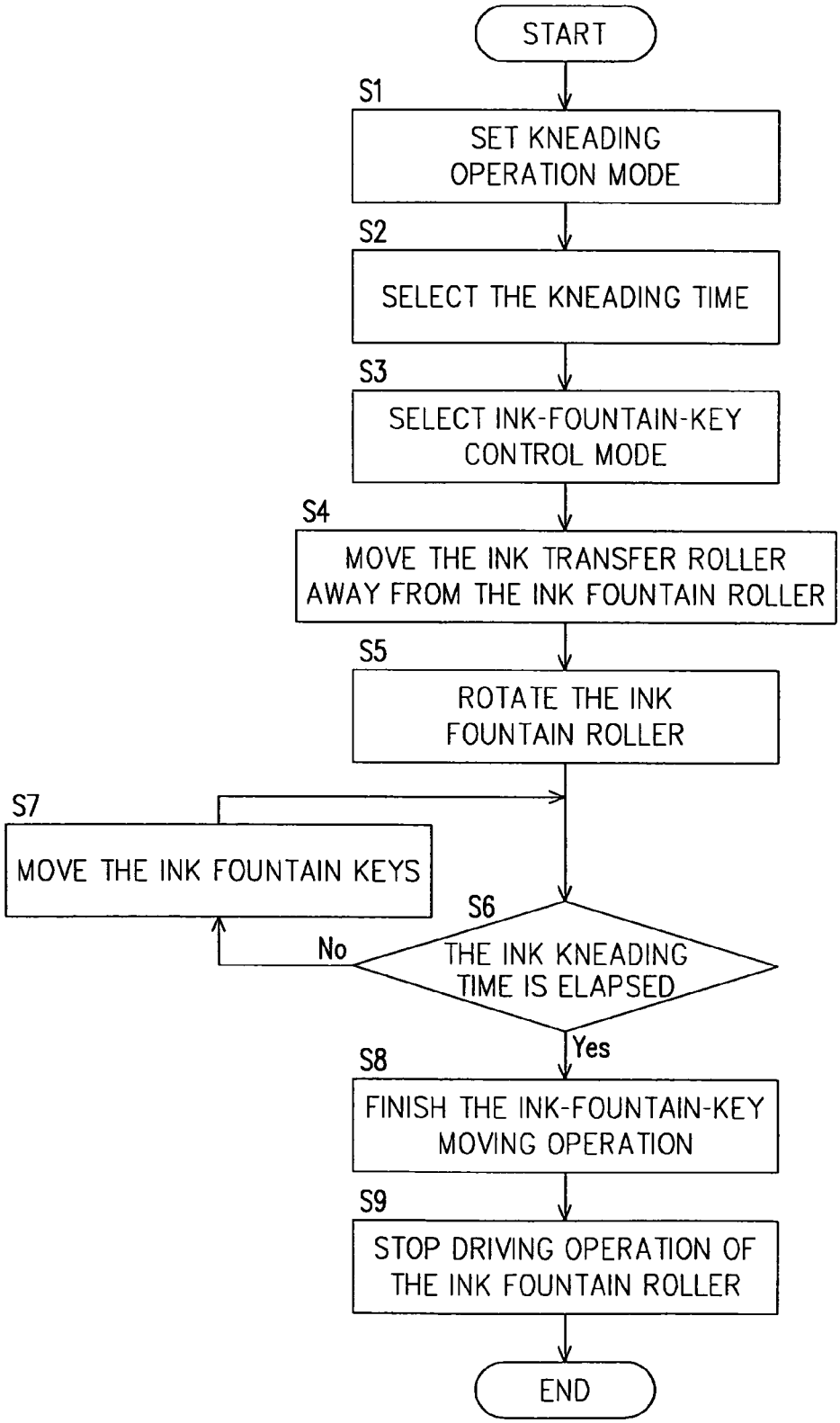
FIG. 6 is a flowchart illustrating a general processing flow for the kneading operation.

FIG. 6 is a flowchart illustrating a general processing flow for the kneading operation. For performing the kneading operation, the operator first presses an ink kneading button (not shown) on the operational panel OP, thereby setting the printing press 100 in an ink kneading operation mode (Step S1). Then, the timer means displays a time period on the operational panel OP in such a manner as to allow the operator to select a time period among twelve different time periods in increments of 5 minutes from 5 minutes to 60 minutes, and the operator selects one of the time periods for the kneading (Step S2). The operational panel OP then displays the above three different ink-fountain-key control modes in such a manner as to allow the operator to select any one of them, and the operator thus selects one of the control modes (Step S3). While any one of the ink-fountain-key control modes (a)–(c) may be implemented for a single kneading operation, two or more of the control modes (a)–(c) may be implemented for every kneading operation.

Then, the ink-transfer-roller pivotally moving means controls the pivotal motion of the pivotally moving unit 70 so as to move the ink transfer roller 16 away from the ink fountain roller 8 towards the ink roller 17 (Step S4), and the ink-fountain-roller driving means controls the driving motion of the roller driving unit 80 so as to rotate the ink fountain roller 8 (Step S5). In Step S6 up to the ink kneading time selected in Step S2, the ink-fountain-key moving means controls the moving operation of the ink-fountain-key moving unit 90 so as to move the ink fountain keys according to the control mode selected in Step S3 (Step S7). In Step S6 after the lapse of the ink kneading time selected in Step S2, the ink-fountain-key moving unit 90 finishes its ink-fountain-key moving operation (Step S8), and the roller driving unit 80 stops its driving operation (Step S9).

According to the printing press 100 as described above, while stopping the feeding of ink onto the ink transfer roller 16, the ink fountain roller 8 is rotated and at least one of the ink fountain keys $K_1$–$K_n$ is moved in the second direction Y, thereby changing the reached position of the at least one of the ink fountain keys $K_1$–$K_n$ relative to the ink fountain roller 8 with time. As a result, the ink kneading operation by the operator for ink in the ink fountain 7 is no longer required. Additionally, any device or unit for ink kneading to be provided independently of the printing press 100 is also no longer required. With this arrangement, in addition to an ink kneading effect which is produced by the kneading of ink in the ink fountain 7 by the rotation of the ink fountain roller 8, the following ink kneading effects can be produced.

Figure 7:
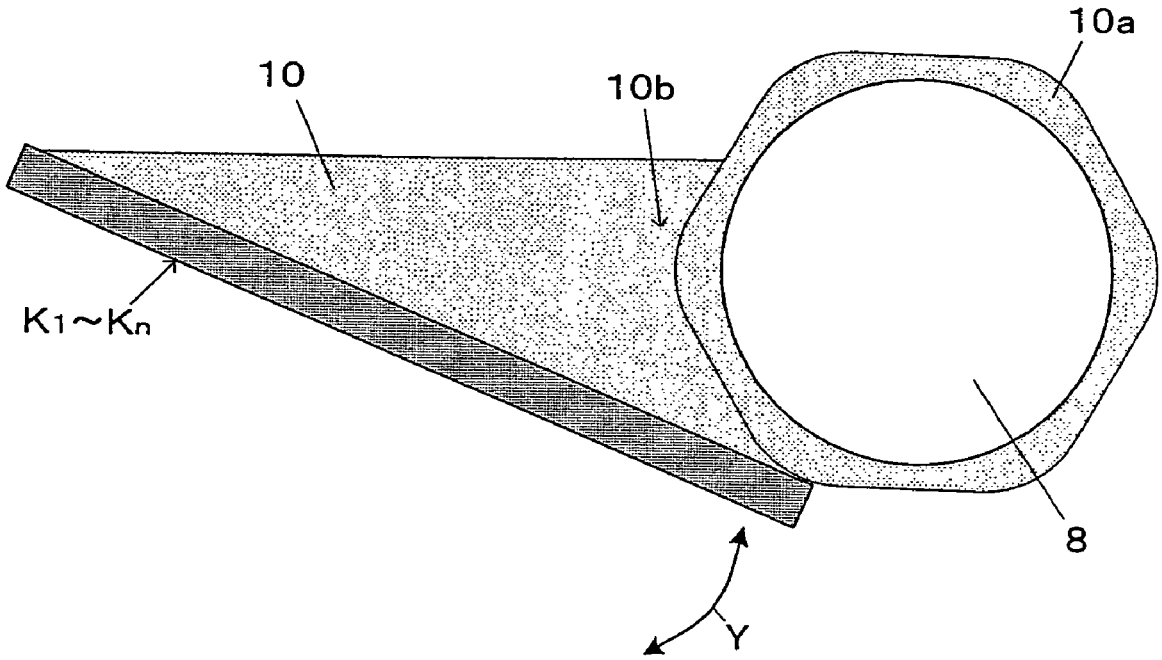
FIG. 7 is a view for explanation of the various actions of the ink fountain keys in the first to third embodiments of the method and printing press, according to the present invention.

In the control mode (a), the ink fountain keys $K_1$–$K_n$ substantially simultaneously reach the same position or substantially the same position relative to the ink fountain roller 8, thereby allowing the ink fountain keys $K_1$–$K_n$ to regularly change the reached positions thereof in a given cycle, as illustrated in FIGS. 3A and 5A. This movement of the ink fountain keys $K_1$–$K_n$ achieves kneading of ink 10 in the ink fountain 7 in the second direction Y, as well as changes the gap between each of the ink fountain keys $K_1$–$K_n$ and the ink fountain roller 8 and hence the amount of ink 10*a* adhered to the circumference of the ink fountain roller 8 and rotated therewith, as illustrated in FIG. 7, so that the variation in amount of ink 10*a* on the circumference of the ink fountain roller 8 achieves kneading ink 10*b* mainly around the ink fountain roller 8 in the radial direction of the roller. In this case, in addition to the kneading effect by kneading ink 10 in the ink fountain 7 by the rotation of the ink fountain roller 8, an ink kneading effect by the movement of the ink fountain keys $K_1$–$K_n$ and an kneading effect by the variation in the amount of ink on the circumference of the ink fountain roller 8 are combined together. As a result, ink 10 in the ink fountain 7 can be more effectively kneaded.

In the control mode (b), in addition to the ink kneading by the rotation of the ink fountain roller 8 in the circumferential direction of the roller, the odd numbered ink fountain keys $K_1$, $K_3$ . . . and the even numbered ink fountain keys $K_2$, $K_4$ . . . respectively and substantially simultaneously reach the same position or substantially the same position relative to the ink fountain roller 8, thereby allowing both the odd numbered ink fountain keys and the even numbered fountain keys to alternatively and regularly change the reached positions thereof in a given cycle, as illustrated in FIGS. 3A and 5A. Therefore, in addition to the ink kneading in the circumferential direction of the roller, ink 10 in the ink fountain 7 is kneaded in the second direction Y by the change in the reached position of the odd and even numbered ink fountain keys $K_1$, $K_3$ . . . , $K_2$, $K_4$ . . . Furthermore, the alternative movement of the adjacent ink fountain keys ($K_1$, $K_2$), and ($K_2$, $K_3$) . . . achieves kneading of ink mainly in regions around these adjacent ink fountain keys ($K_1$, $K_2$), ($K_2$, $K_3$) . . . And still furthermore, the change in reached positions changes the gap between each of the odd numbered ink fountain keys $K_1$, $K_3$ . . . and the even numbered ink fountain keys $K_2$, $K_4$ . . . relative to the ink fountain roller 8, and accordingly the amount of ink 10*a* adhered to the circumference of the ink fountain roller 8 and rotated therewith is varied between regions of the odd numbered ink fountain keys and regions of the even numbered ink fountain keys so that ink 10*b* mainly around the ink fountain roller 8 is kneaded in the radial direction of the roller due to the variation in the amount of ink on the circumference of the ink fountain roller 8. In this case, the kneading effect by kneading ink 10 in the ink fountain 7 by the rotation of the ink fountain roller 8 is combined with an ink kneading effect by the movement of the odd and even numbered ink fountain keys $K_1$, $K_3$ . . . , $K_2$, $K_4$ . . . , an ink kneading effect by the alternate movement of the adjacent ink fountain keys ($K_1$, $K_2$), ($K_2$, $K_3$) . . . , and an kneading effect by the variation in the amount of ink on the circumference of the ink fountain roller 8. As a result, ink 10 in the ink fountain 7 can be more effectively kneaded.

In the control mode (c), in addition to the ink kneading by the rotation of the ink fountain roller 8 in the circumferential direction of the roller, three adjacent ink fountain keys ($K_1$, $K_2$, $K_3$), ($K_4$, $K_5$, $K_6$) . . . of the 1st to mth ink-fountain-key groups $KA_1$–$KA_m$ are moved to reach substantially simultaneously the same position or substantially the same position relative to the ink fountain roller 8, thereby allowing the 1st to mth ink-fountain-key groups to change the reached positions thereof respectively with a predetermined time lag, regularly in a given cycle. This causes ink 10 in the ink fountain 7 to be kneaded in the second direction Y by the movement of the 1st to mth ink-fountain-key groups $KA_1$–$KA_m$. Furthermore, ink mainly in regions around the adjacent ink-fountain-key groups ($KA_1$, $KA_2$), ($KA_2$, $KA_3$) . . . is kneaded by the sequential movement of these adjacent ink-fountain-key groups ($KA_1$, $KA_2$), ($KA_2$, $KA_3$) . . . , with a predetermined time lag, thus forming a wave-like pattern. And still furthermore, through this positional change, the gap between each of the 1st to mth ink-fountain-key groups $KA_1$–$KA_m$ and the ink fountain roller 8 is changed, and hence the amount of ink 10*a* adhered to the circumference of the ink fountain roller 8 and rotated therewith is varied, as illustrated in FIG. 7. Thus, ink 10*b* mainly around the ink fountain roller 8 is kneaded in the radial direction of the ink fountain roller 8 due to the variation in the amount of ink on the circumference of the ink fountain roller 8. In this case, the kneading effect by kneading ink 10 in the ink fountain 7 by the rotation of the ink fountain roller 8 is combined with an ink kneading effect by the movement of the 1st to mth ink-fountain-key groups $KA_1$–$KA_m$, an ink kneading effect by the relative movement of the adjacent ink-fountain-key groups ($KA_1$, $KA_2$), ($KA_2$, $KA_3$) . . . and an kneading effect by the variation in the amount of ink on the circumference of the ink fountain roller 8. As a result, ink 10 in the ink fountain 7 can be more effectively kneaded.

This specification is by no means intended to restrict the present invention to the preferred embodiments set forth therein. Various modifications to the method of kneading ink of a printing press and the printing press, as described herein, may be made by those skilled in the art without departing from the spirit and scope of the present invention as defined in the appended claims.

What is claimed is:

1. A method of kneading ink stored in an ink fountain of a printing press, in which an ink fountain roller rotates so as to make ink adhere to a circumference thereof and feed ink therefrom to a downstream roller, at least one ink fountain key that is aligned in a first direction parallel to the axis of the ink fountain roller and disposed so as to be moved back and forth in a second direction orthogonal to the first direction, thereby allowing each of said at least one ink fountain key and the ink fountain roller to have a predetermined gap therebetween and hence the amount of ink to be fed to the downstream roller to be determined, comprising:

rotating the ink fountain roller while preventing ink from being fed to the downstream roller; and moving at least one of the at least one ink fountain key in the second direction during the rotation of the ink fountain roller so as to allow the at least one of the at least one ink fountain key to change a position thereof relative to the ink fountain roller of the ink fountain with time.

2. The method of kneading ink according to claim 1, wherein said at least one ink fountain key comprises 1st to nth ink fountain keys, in which n is an integer of 2 or larger, said 1st to nth ink fountain keys being aligned in the first direction and disposed so as to be movable in the second direction, the method further comprising:

rotating the ink fountain roller while preventing ink from being fed to the downstream roller;

moving an odd numbered ink fountain key of said 1st to nth ink fountain keys so as to allow said odd numbered ink fountain key to reach substantially simultaneously the same position or substantially the same position relative to the ink fountain roller during the rotation of the ink fountain roller;

moving an even numbered ink fountain key of said 1st to nth ink fountain keys so as to allow said even numbered ink fountain key to reach substantially simultaneously the same position or substantially the same position relative to the ink fountain roller during the rotation of the ink fountain roller, thereby allowing both the odd numbered ink fountain key and the even numbered ink fountain key to alternately change the reached positions thereof with time.

3. A printing press comprising:

an ink fountain for storing ink;

an ink fountain roller that rotates so as to make ink adhere to a circumference thereof and feed ink therefrom to a downstream roller;

a roller positioning unit that moves at least one of the ink fountain roller and the downstream roller so as to allow the both rollers to be selectively held close to each other and away from each other;

a roller driving unit that rotates the ink fountain roller;

at least one ink fountain key that is aligned in a first direction parallel to the axis of the ink fountain roller and disposed to be movable in a second direction orthogonal to the first direction;

an ink-fountain-key moving unit that moves each of said at least one ink fountain key in the second direction, thereby determining the amount of ink to be fed to the downstream roller; and a control part that controls the roller positioning unit, the roller driving unit and the ink-fountain-key moving unit so as to rotate the ink fountain roller while preventing ink from being fed to the downstream roller, moving at least one of said at least one ink fountain key in the second direction during the rotation of the ink fountain roller, thereby allowing said at least one of the at least one ink fountain key to change a position thereof relative to the ink fountain roller of the ink fountain with time.

4. The printing press according to claim 3, wherein said at least one ink fountain key comprises 1st to nth ink fountain keys, in which n is an integer of 2 or larger, said 1st to nth ink fountain keys being aligned in the first direction and disposed so as to be movable in the second direction, and said control part controls the roller positioning unit, the roller driving unit and the ink-fountain-key moving unit so as to:

rotate the ink fountain roller while preventing ink from being fed to the downstream roller;

move an odd numbered ink fountain key of said 1st to nth ink fountain keys so as to allow said odd numbered ink fountain key to reach substantially simultaneously the same position or substantially the same position relative to the ink fountain roller during the rotation of the ink fountain roller; and move an even numbered ink fountain key of said 1st to nth ink fountain keys so as to allow said even numbered ink fountain key to reach substantially simultaneously the same position or substantially the same position relative to the ink fountain roller during the rotation of the ink fountain roller, thereby allowing both the odd numbered ink fountain key and the even numbered ink fountain key to alternately change the reached positions thereof with time.

* * * * *